US006015618A

United States Patent [19]

Orima

[11] Patent Number: 6,015,618

[45] Date of Patent: Jan. 18, 2000

[54] COMPOSITE YARN COMPRISED OF CHAIN STITCH YARN AND INLAY YARN

[75] Inventor: Hajime Orima, Sakai-machi, Japan

[73] Assignee: Firster Co., Ltd., Sakai-Machi, Japan

[21] Appl. No.: 08/727,620

[22] PCT Filed: Apr. 17, 1995

[86] PCT No.: PCT/JP95/00745

§ 371 Date: Oct. 18, 1996

§ 102(e) Date: Oct. 18, 1996

[87] PCT Pub. No.: WO95/29278

PCT Pub. Date: Nov. 2, 1995

[30] Foreign Application Priority Data

Apr. 21, 1994 [JP] Japan ..... 6-083172
Apr. 21, 1994 [JP] Japan ..... 6-083194

[51] Int. Cl.[7] ..... D02G 3/00

[52] U.S. Cl. ..... 428/373; 57/225; 57/244; 57/207; 57/210; 66/169 R; 87/2; 87/3; 87/13; 428/364; 428/374; 428/377; 428/394; 442/184; 442/190; 442/197; 442/306; 442/310

[58] Field of Search ..... 428/364, 377, 428/373, 374, 394; 57/244, 248, 210, 207, 206, 224, 225; 442/189, 190, 199, 311, 306, 182, 184, 197; 66/169 R; 87/3, 13, 2

[56] References Cited

U.S. PATENT DOCUMENTS 4,005,569 2/1977 Corbiere ..... 428/369
4,173,131 11/1979 Pendergrass et al. ..... 66/192
4,433,493 2/1984 Poisson ..... 428/229
4,750,324 6/1988 Tochacek et al. ..... 57/210
4,912,781 4/1990 Robins et al. ..... 57/200

FOREIGN PATENT DOCUMENTS

A2 492418 4/1982 France .
C614545 5/1935 Germany .
1032464 6/1958 Germany .
2-14061 2/1990 Japan .
1368927 10/1974 United Kingdom .
A1 425128 2/1976 United Kingdom .
A1 538924 1/1979 United Kingdom .
2090881 7/1982 United Kingdom .

*Primary Examiner*—Marion E. McCamish
*Assistant Examiner*—J. M. Gray
*Attorney, Agent, or Firm*—Christie, Parker & Hale, LLP

[57] ABSTRACT

A composite yarn comprised of a chain stitch yarn knitted from a yarn A and at least an inlay yarn of a yarn B inserted into the chain stitch yarn along a longitudinal direction thereof. Since the chain stitch yarn and the inlay yarn are surely interlaced with each other in the composite yarn, there is little chance that the chain stitch yarn and the inlay yarn are separated in use. A preferable apparatus for manufacturing the composite yarn in accordance with the present invention may include individual winding mechanisms downstream of each knitting station in a warp knitting machine.

8 Claims, 4 Drawing Sheets

22a
22b
22c
22d
22e
22f
15
15a
16a
21a
15b
16b
21b
15c
16c
21c
15d
16d
21d
15e
16e
21e
15f
21f
16
16f
A
B
C
D
10
12a
12b
12c
12d
12e
12f
13a
13b
13c
13d
13e
13f
11a
11b
11c
11d
11e
11f
E
23a
23b
23c
23d
23e
23f
18a
19a
18b
19b
18c
19c
18d
19d
18e
19e
18f
19f
14
17
20

22a
.2b
22c
22d
22e
22f
15
15a
16a
21a
15b
16b
21b
15c
16c
21c
15d
16d
21d
15e
16e
21e
15f
16f
21f
16
A
B
C
D
E
12a
12b
12c
12d
12e
12f
13c
13b
13c
13d
13e
13f
11a
11b
11c
11d
11e
11f
23a
23b
23c
23d
23e
23f
24a
24b
24d
24f
24d
24e
25a
25b
25c
25d
25e
25f
14
17
26
27

COMPOSITE YARN COMPRISED OF CHAIN STITCH YARN AND INLAY YARN

TECHNICAL FIELD

This invention relates to a composite yarn comprised of a chain stitch yarn and at least one inlay yarn and a manufacturing method thereof. More particularly, this invention relates to a composite yarn having a novel structure which can be obtained by using a warp knitting machine and remarkable features which cannot be obtained in conventional composite yarns, but can be obtained by the above-mentioned novel structure, and a manufacturing method thereof.

PRIOR ART

Various types of composite yarn have been known. In general, composite yarn is divided into two types, and one type of composite yarn is a yarn composed of fibers constituted with at least two components and another type of composite yarn is a yarn in which at least two yarns constituting the composite yarn are combined with each other. The composite yarn of the present invention is of the latter type.

A typical yarn of the latter composite yarn type is a twisted yarn. The twisted yarn has superior tensile strength and abrasion resistance, compared with a single yarn, and a beautiful appearance. Accordingly, the twisted yarn can be widely used in a woven fabric, a knitted fabric, a rope or the like. However, the twisted yarn is generally a non-stretchable yarn. For the sake of the above feature, when a final product having elastically stretchable property (hereinafter, referred as stretchability) is required, a cover yarn manufactured by using a stretchable yarn such as a spandex yarn as a core yarn and wrapping it with a non-stretchable yarn such as a spun yarn, a textured yarn or the like, in one layer or two layers, is used.

However, since the other yarn is wrapped about the core yarn in the covering yarn, the appearance of the covering yarn becomes to dull. Accordingly, the covering yarn cannot be used in the applications of a knitted fabric or a won en fabric in which luster is required. However, there is a big demand for a yarn having stretchability and luster. Accordingly, it has been attempted to apply a luster to the covering yarn by using a multifilament as the non-stretchable yarn wrapping the core yarn. However, when the covering yarn prepared by using a stretchable yarn as the core yarn and wrapping the non-stretchable multifilament around the core yarn shrinks due to shrinkage of the core yarn, the multifilament becomes loose on the core yarn due to an inferior holding ability of the multifilament on the core yarn. As a result, when this covering yarn is used in a successive process, i.e., a knitting process or a weaving process, the covering yarn is caught on a yarn guide or the like and many breakages of the yarn are generated, and thus it becomes impossible to obtain a knitted fabric or a woven fabric having superior quality. Further, a final product made from the knitted fabric or the woven fabric prepared by using this covering yarn has a tendency to generate snagging on the fabric in use and thus those fabrics have inferior utility. Accordingly, a composite yarn which has as broad a usefulness as a yarn having superior stretchability and luster has not yet been provided.

Further, the covering yarn can be used as a pattern yarn of an embroidery lace. When the embroidery lace is used for a lady's underwear, it is required that a ground cloth and a pattern portion embroidered on the ground cloth have the substantially same stretchability to improve the fitting of the embroidery lace to a human body. Accordingly, a stretchable warp knitted fabric such as a power net has been used as the ground cloth in a conventional embroidery lace, and a yarn with stretchability which is controlled to a predetermined value in an embroidering process, but is generated by treatment in a successive dying and finishing process has been used as an embroidery yarn.

The pattern in the embroidery lace is essentially formed by lock-stitch-sewing two embroidery yarns into the ground cloth as a face yarn and a back yarn. If the embroidery yarn has stretchability, it is impossible to form a loop in the lock-stitch-sewing process. Accordingly, as described hereinbefore, the yarn the stretchability of which is controlled to a condition in which the embroidery operation can be applied without any trouble, but is generated by releasing the above restraint in the treatment of the successive dying and finishing process has been used. Hereinafter, the above yarn is referred to as "a potentially stretchable yarn".

As an example of the above-mentioned potentially stretchable yarn, Japanese Unexamined Patent Publication (Kokai) No. 2-14061 disclosed that a stretchable yarn supplied in a relaxed state is arranged in parallel with a yarn of watersoluble fibers without applying tension to make a core yarn and then a yarn of non-watersoluble fibers is wrapped in a spiral state around the core yarn. When a fabric manufactured by embroidering the above described covering yarn on a lace ground cloth to form patterns thereon is treated in a hot water, the yarn of watersoluble fibers in the core yarn is dissolved, and thus the embroidery yarn, i.e., the covering yarn in the pattern can stretch in the same way as the lace ground cloth.

As described hereinbefore, this potentially stretchable yarn has a feature that when using the yarn as an embroidery yarn forming the pattern in an embroidery lace, the yarn can offer corresponding stretchability to that of the lace ground cloth to the pattern of the embroidery lace, but this yarn is likely to produce frequent yarn breakage in an embroidery process because many pills, having a loop-like shape appear on a surface thereof. There is theoretically no generation of pills in this potentially stretchable yarn, because the potentially stretchable yarn is arranged in parallel with the yarn of watersoluble fibers without applying tension, as described hereinbefore. However since it is impossible to wind a yarn without tension in any winding apparatus, some tension must be actually applied to the potentially stretchable yarn upon winding. Accordingly the pills are generated in the potentially stretchable yarn due to elongation of the potentially stretchable yarn caused by the tension in the potentially stretchable yarn. When the potentially stretchable yarn having pills on the surface thereof is accommodated in a shuttle of an embroidery machine and the yarn is withdrawn through an eye of the shuttle, the yarn is likely to clog the eye of the shuttle with the pills and thus the yarn breakage is likely to happen.

Covering yarns having various appearances can be obtained by changing type of the core yarn, the yarn wrapped around the core yarn and the wrapping condition, and those covering yarns can be used in various applications as a fancy yarn having a specific appearance. Since the demand for the fancy yarn depends on fashion, a fancy yarn having a novel appearance is always required. However development of fancy yarns, manufactured as covering yarns, has continued in long years and there is a little probability that a fancy yarn of the covering yarn type having a novel appearance will be developed. Accordingly, a fancy yarn based on a yarn having a novel technical concept is always required.

FR-A-2 492 418 disclosed a thermo-adhesive elastic yarn comprised of an elongated elastic element arranged in a center position of the thermo-adhesive elastic yarn, and another elongated element arranged around the elongated elastic element and coated at least locally with a thermo-adhesive substances. A core of the elongated elastic element illustrated in FIG. 1 of FR-A-2 492 418 was associated to a wrapping yarn of the elongated element which is wound into successive spires. Further FR-A-2 492 418 disclosed another example of the thermo-adhesive elastic yarn in FIG. 4. In this example, a strand knitted to form successive stitches is used in place of the wrapping yarn in FIG. 1. However, as can be easily found by a person having ordinary skill in the art, the strand knitted to form successive stitches in FIG. 4 was not a knitted yarn which can be manufactured by a knitting method. Namely, the knitted yarn manufactured by the knitting method must be such a one that a new loop is passed through an old loop by an action of a knitting needle, which allows the loops to be untied by merely pulling an end of the yarn. The construction of FR patent is, at any means, not a one having a succession of loops knitted by a knitting process, which makes it impossible that the yarn is produced even under a manual industrial scale.

DISCLOSURE OF THE INVENTION

The present invention aims to provide a composite yarn having a novel yarn structure showing novel features and improved performance compared to conventional composite yarns.

The present invention further aims to provide a preferable composite yarn manufacturing method to enable manufacture of the above novel composite yarn.

The present invention can be attained in a composite yarn comprised of series of loops of a yarn A in the length of the composite yarn and at least an inlay yarn of a yarn B inserted into the series of loops along a longitudinal direction thereof, characterized in that said series of loops is a chain stitch yarn.

The composite yarn in accordance with the present invention has features in the yarn structure that the chain stitch yarn covers the inlay yarn and the inlay yarn is interlaced with loop portions of the chain stitch yarn, thereby the composite yarn in accordance with the present invention has the following characteristics which are extremely novel compared with conventional composite yarns such as a twisted yarn or a covering yarn.

1. It is possible to manufacture a composite yarn by combining a chain stitch yarn with an inlay yarn which is different in yarn characteristics such as a stretch modulus or the like from those of the chain stitch yarn. Contrary, it was not generally carried out to apply a twist on two or more yarns a yarn characteristic such as a stretch modulus of which is different each other, because it is impossible to obtain a yarn having a specific feature by the above way. In a covering yarn formed by wrapping a sheath yarn around a core yarn having no stretchability, it is possible to form the covering yarn having utility, even if yarns having different characteristics are used as the core yarn and the sheath yarn.

However, in the case that a yarn having a large stretchability such as a spandex yarn is used as the inlay yarn in the composite yarn in accordance with the present invention or as the core yarn in the covering yarn, since stretch behavior of the covering yarn is completely different from that of the composite yarn in accordance with the present invention due to a difference of a yarn structure, there is following problem. Namely, when the covering yarn or the composite yarn is stretched by an external force, the yarns can be freely stretched according to an elongation property of the spandex yarn or the like used as the core yarn or the inlay yarn. But since the sheath yarn is wrapped in a spiral state around the core yarn in the covering yarn, when the covering yarn stretched in a large quantity shrinks by removing the external force, the spiral arrangement of the sheath yarn is likely to be deformed to an irregular state and thus it is impossible to maintain an original spiral arrangement of the covering yarn in use. Accordingly, it is impossible to sufficiently utilize the characteristics of the yarn having a big stretchability such as the spandex yarn in the covering yarn, and the narrow stretchability of the spandex yarn or the like limited by a wrapping condition of the sheath yarn is only utilized in the covering yarn.

Contrary, since the chain stitch yarn in the composite yarn in accordance with the present invention is formed by several loop portions, the chain stitch yarn can be stretched in a broad range upon applying an external force and the original shape of the chain stitch yarn can be recovered upon removing the external force. There is no probability that the loops constituting the chain stitch yarn are deformed. Namely, when manufacturing the composite yarn in accordance with the present invention, it is possible to insert the inlay yarn into the chain stitch yarn under any condition between a condition holding loosely the inlay yarn and a condition stretching fully the inlay yarn. Accordingly, it is possible to utilize in the more broad range the characteristics of the yarn having a big stretchability such as the spandex yarn used as the inlay yarn in the composite yarn.

In the result, the present invention can provide the composite yarns having various properties by suitably selecting and combining a yarn used for the chain stitch yarn and a yarn used for the inlay yarn.

2. As described hereinbefore, the surface of the composite yarn in accordance with the present invention is formed by the chain stitch yarn. A loop of yarn constituting the chain stitch yarn is composed of vertical portions extending substantially parallel to an axis of the chain stitch yarn and horizontal portions extending, with a curved profile, in a direction lateral to the axis of the chain stitch yarn. However, the sheath yarn in the covering yarn extends in a direction crossing the axis of the covering yarn and, the yarn constituting the twisted yarn are arranged with a constant angle to the axis of the twisted yarn. Accordingly, when using a yarn having the same type and the same structure to make the chain stitch yarn in accordance with the present invention, the sheath yarn of the covering yarn or the yarn constituting the twisted yarn, respectively, it is possible to apply the most superior luster on the composite yarn in accordance with the present invention.

On the other hand, when manufacturing a covering yarn by using a yarn having stretchability as a core yarn, it is necessary to use a yarn having stretchability as a sheath yarn, because when using a non-stretchable multifilament as the sheath yarn, it is impossible to apply clean appearance onto the covering yarn due to slack of the non-stretchable multifilament during the wrapping process. Accordingly, a textured yarn may use as the sheath yarn in the covering yarn. Since the textured yarn has a dull appearance due to yarn structure thoseof, it is impossible to manufacture a yarn having the stretchability and the superior luster as the covering yarn.

Contrary, since it is possible to knit the chain stitch yarn by using the non-stretchable yarn, it is possible to manufacture the composite yarn having the superior luster by inserting any type of an inlay yarn into the chain stitch yarn of the non-stretchable yarn.

Accordingly, when a yarn of the same fiber and having the same structure is used as a chain-stitch yarn in accordance with the present invention, a sheath yarn of a covering yarn, or a yarn constituting a twisted yarn, the most superior luster can be applied to the composite yarn in accordance with the present invention.

3. The composite yarn in accordance with the present invention has a structure that an inlay yarn is tightened by horizontal portions of the chain stitch yarn, and a yarn constituting the chain stitch yarn passes partially through the other portions of the chain stitch yarn. And thus, it is possible to control the tightening force by adjusting yarn tension during a knitting process, and the yarn constituting the chain stitch yarn can be restrained by the above passing-through-portion of the yarn. Accordingly, the composite yarn in accordance with the present invention can maintain superior durability against abrasion compared with the twisted yarn formed by merely twisting two or more yarns and the covering yarn formed by wrapping a yarn around the outside of a core yarn.

A yarn in which the type and size of fiber, the yarn morphology such as monofilament, multifilament, number of twists, number of crimps or the like, characteristics of yarn, and a fineness of yarn are completely the same may be used as the yarn A and the yarn B. However, yarns in which at least one of the type and size of fiber, the yarn morphology, the characteristics of yarn, or the fineness of yarn is different may be used as the yarn A and the yarn B.

As for the type of fiber mentioned above, various fibers such as natural fibers including cotton fiber, wool fiber, hemp fiber, silk fiber or the like, regenerated cellulose fibers including viscose rayon fiber, cuprammonium rayon fiber, acetate rayon fiber or the like, synthetic fibers including polyester fiber, polyamide fiber, polyacrylic fiber or the like, and elastic yarns including spandex or the like, can be used.

The characteristics mentioned above include physical properties of the yarn such as strength, elongation, stretch modules, bulkiness or the like and chemical properties of the yarn such as solubility in a water or a solvent, heat resistance or the like.

The fineness mentioned above means size of the yarn expressed by yarn count or denier.

When either one of the yarn A and the yarn B is a non-stretchable yarn and the other yarn is a stretchable yarn, a composite yarn which can be used in various applications as a yarn with stretchability can be obtained. For example, when a composite yarn in accordance with the present invention is manufactured by using a non-stretchable yarn which can be dissolved in a solvent including water or decomposed by heat as the yarn A and using the stretchable yarn as the yarn B, and when using the above composite yarn as an embroidery yarn to make a pattern on a lace ground cloth with stretchability, such as a powernet and treating the obtained lace ground cloth with a solvent or heat to remove the non-stretchable yarn from the obtained lace ground cloth, an embroidery lace in which the pattern can stretch with the lace ground cloth can be obtained.

A watersoluble polyvinyl alcohol yarn which can be easily dissolved in hot water, a diacetate yarn which can be dissolved by acetone, a yarn which can be decomposed by heat or light or the like can be used as the non-stretchable yarn. However it is preferable that the above non-stretchable yarn cannot be broken by the tension applied the non-stretchable yarn during an embroidery operation.

A spandex yarn or a covering yarn using the spandex yarn as a core yarn is generally used as the stretchable yarn. However, a hard twist yarn or a textured yarn can also be used in some applications of the embroidery lace as the stretchable yarn. The number of the non-stretchable yarns and the stretchable yarns used in the composite yarn in accordance with the present invention are lot limited to one, and two or more non-stretchable yarns and stretchable yarns may be used to manufacture the composite yarn. The number of the non-stretchable yarns essentially depend on the type and fineness of th stretchable yarn used in the composite yarn and the decorative effect of the pattern in the embroidery lace. However it is preferable that the quantity of thy non-stretchable yarn to be dissolved or decomposed in the subsequent process is as small as possible while the strength of the non-stretchable yarn is able to withstand the tension applied during an embroidery operation and still maintain the stretchable yarn in a chain stitch structure.

Since the stretchable yarn in the composite yarn in accordance with the present invention is interlaced with loops of the chain stitch yarn formed by the non-stretchable yarn, generation of pills is reduced compared with the conventional potentially stretchable yarn when used as an embroidery yarn and the surface of the composite yarn is relatively smooth. Accordingly, the clogging of the composite yarn in an eyes of a shuttle is remarkably reduced during the embroidery process and thus yarn breakage is reduced. Further, since passing of the composite yarn through the eye of the shuttle is smooth, irregularities in the tension applied to the composite yarn is almost eliminated and thus a clear pattern can be formed on the surface of the embroidered lace.

The inlay yarn in the above described composite yarn is constituted with only one stretchable yarn, but it is possible to provide another type of composite yarn, to be used as an embroidery yarn, by using the inlay yarn prepared by arranging the stretchable yarn held in relaxed state with the non-stretchable yarn which is the same type of the yarn used in the chain-stitch yarn and can be dissolved by a solvent including water or decomposed by heat. When this type of composite yarn is used in embroidery lace as the embroidery yarn, the non-stretchable yarn in the inlay yarn controls the stretch applied to the stretchable yarn in the inlay yarn during the embroidery process and thus it is possible to arrange the embroidery yarn in a relaxed state into the pattern of the embroidery lace. Accordingly, after the chain stitch yarn and the non-stretchable yarn constituting the one of the inlay yarns in the embroidery lace are removed in a dyeing and finishing process, portions constituting the patterns in the embroidery lace can be freely stretched in accordance of the stretch applied to the lace ground cloth.

A composite yarn, the chain stitch yarn of which is removed in the subsequent process, has been described. However a composite yarn in accordance with the present invention is not limited to the abovementioned composite yarn, and includes a composite yarn, the chain stitch yarn of which is kept in the composite yarn in a final application. For example, a composite yarn obtained by knitting a chain stitch yarn of a non-stretchable filament and inserting a stretchable yarn into the chain stitch yarn has superior stretchability and luster. In this composite yarn, it is preferable that a spandex yarn, the stretch modulus of which is large, is used as the stretchable yarn. However, a twisted yarn of hard twist or a textured yarn may be used as the stretchable yarn in place of the spandex yarn. A regenerated rayon filament such as a viscose rayon multifilament, a cuprammonium rayon multifilament, and an acetate rayon multifilament, or a synthetic multifilament can be used as the non-stretchable filament. Since vertical portions of the chain stitch yarn in accordance with the present invention are arranged along the axial direction of the composite yarn, the composite yarn can show luster due to the yarn structure and, further, since the chain stitch yarn is constituted with the filament, the luster of the composite yarn is remarkably improved. When using a multifilament with single filaments with an irregular cross section, the luster of the composite yarn is further improved.

Non-stretchable spun yarns or the like can be used for the non-stretchable yarn in place of the non-stretchable filament. Further, when the spandex yarn is used for the inlay yarn, the twisted yarn with a hard twist or the textured yarn having a relatively low stretch modulus compared with that of the spandex yarn can be used in the chain stitch yarn.

The non-stretchable yarn constituting the chain stitch yarn and the stretchable yarn used as the inlay yarn are interlaced with each other by the loops in a warp knitting structure constituted by the chain stitch yarn. Accordingly, the non-stretchable yarn and the stretchable yarn in the composite yarn in accordance with the present invention are held at predetermined intervals by another yarn, and thus a portion of the non-stretchable yarn does not protrude from the composite yarn when the stretchable yarn shrinks. As the result of this feature of the composite yarn, yarn breakage in subsequent knitting or wearing processes is reduced.

A preferable method for manufacturing the composite yarn in accordance with the present invention will be described in detail hereinafter.

As described above, the composite yarn in accordance with the present invention is comprised of the chain stitch yarn and the inlay yarn. The chain stitch yarn can be manufactured by a hand knitting operation using a hook needle. However, it is impossible to arrange the inlay yarn into the chain stitch yarn by the hand knitting operation. Further it is impossible to carry out mass production of the composite yarn in accordance with the present invention using hand knitting operation.

However, it is possible, using an ordinary knitting technique, to knit the chain stitch yarn and insert the inlay yarn into the chain stitch yarn using a warp knitting machine. However, the warp knitting machine is intended to knit a warp knitting fabric. Namely, a plurality of yarns supplied from yarn guide eye needles of a guide form the warp knitting fabric by moving the yarns over several adjacent knitting needles by a shogging motion of the guide, and the obtained warp knitting fabric is wound on a beam. Accordingly, it is impossible to individually wind the composite yarn in accordance with the present invention onto a yarn package in the conventional warp knitting machine.

The industrial production of the composite yarn in accordance with the present invention can be attained by arranging a plurality of knitting stations along a needle bar, knitting a composite yarn at every knitting station, and winding the composite yarn onto the individual yarn package by a winding mechanism arranged downstream of the knitting station.

More particularly, a preferable method for manufacturing the composite yarn in accordance with the present invention by feeding individually a yarn A into each knitting station of a warp knitting machine equipped with a needle bar on which a plurality of knitting needles are arranged in a straight line and at least two guides on which a plurality of yarn guide eye needles are arranged in a straight line to knit series of loops of the yarn A, and feeding individually a yarn B into the same knitting station to insert the yarn B into the series of loops of the yarn A as an inlay yarn to form the composite yarn, characterized in that the yarn A is supplied to a front side guide, the front side guide and the knitting needle are moved to knit a chain stitch yarn in such a manner that a new knitting stitch is formed by bending a yarn portion continuing to a yarn portion constituting a preceding knitting stitch to make a loop of a new knitting stitch and passing the loop of the new knitting stitch through a loop of the precedings knitting stitch, the yarn B is simultaneously supplied to at least one back side guide, the back side guide and the knitting needle are moved to insert the yarn B into the chain stitch yarn as the inlay yarn, to form the composite yarn, and the composite yarn is wound onto a yarn package by a winding mechanism downstream of the knitting station.

The winding mechanism may be individually arranged at a position corresponding to each knitting station or may be arranged for each group in a plurality of knitting stations. Further, since the distance between adjacent knitting stations is small, it is preferable to arrange the plurality of winding mechanisms in least two rows in such a manner that the winding mechanisms are staggered to the back and front at every adjacent positions. It is possible to make the height of each yarn package large by the above arrangement and thus to wind a large amount of the composite yarn onto a yarn package.

BEST MODE FOR CARRYING OUT THE INVENTION

The present invention will be described hereinafter in connection with the accompanying drawings showing embodiments of the present invention.

Figure 1:
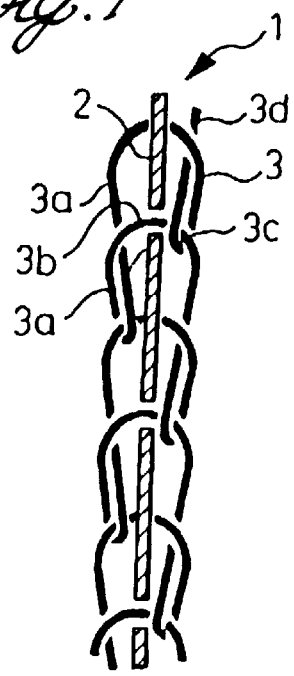
FIG. 1 is a view showing the structure of an example of a composite yarn in accordance with the present invention.

As shown in FIG. 1, a composite yarn 1 in accordance with the present invention is comprised of a chain stitch yarn 3 of an open lap and an inlay yarn 2 inserted, along a longitudinal direction of the chain stitch yarn 3, into the chain stitch yarn 3. The chain stitch yarn 3 is comprised of yarn portions 3*a* arranged substantially along an axial direction of the chain stitch yarn 3 and yarn portions 3*b* arranged in a state crossing the axis of the chain stitch yarn 3. Further the chain stitch yarn 3 includes portions 3*c* where a yarn constituting the chain stitch yarn 3 is interlaced with a U-shape each other and portions 3*d* where the yarn constituting the chain stitch yarn 3 is passed through each other. Accordingly, the composite yarn 1 having the chain stitch yarn 1 as a sheath portion thereof can sufficiently reflect light from the yarn portions 3*a* which are substantially in parallel to the axial direction of the composite yarn 1, and thus the composite yarn 1 in accordance with the present invention has sufficient luster. Further since the inlay yarn 2 is restricted by the yarn portion 3*b* crossing the axis of the composite yarn, there is little probability that the inlay yarn 2 will slip against the chain stitch yarn 3 when the composite yarn in accordance with the present invention is used in a product such as a knitted fabric or a woven fabric. Since every portion of the chain stitch yarn 3 is restricted by the yarn portion 3*c* and the yarn portion 3*d*, the composite yarn in accordance with the present invention can have superior resistance to abrasion.

Figure 2:
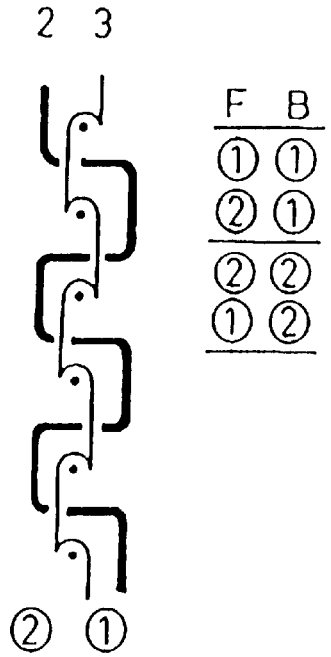
FIG. 2 is a threading diagram of the composite yarn of FIG. 1.

FIG. 2 shows a threading diagram of the composite yarn of FIG. 1. As can be seen in FIG. 2, the chain stitch yarn 3 is knitted from a yarn supplied from a front side guide in a warp knitting machine and an inlay yarn 2, supplied from a back side guide in the warp knitting machine, is inserted in the longitudinal direction of the chain stitch yarn and interlacing with the chain stitch yarn to form the composite yarn.

The structure of the composite yarn shown in FIG. 1 is only a standard example, and the composite yarn in accordance with the present invention is not limited to the structure shown in FIG. 1. A composite yarn having structures shown in FIG. 3 or FIG. 4 can be used.

Figure 3:
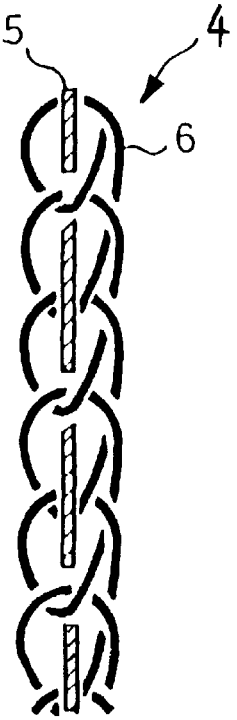
FIG. 3 is a view showing a yarn structure of another example of a composite yarn in accordance with the present invention.

A composite yarn 4 in accordance with the present invention shown in FIG. 3 is comprised of a chain stitch yarn 6 of a close lap and an inlay yarn 5 inserted along a longitudinal direction of the chain stitch yarn 6 into the chain stitch yarn 6. This composite yarn 4 also has a portion of the chain stitch yarn 6 arranged substantially along an axial direction of the composite yarn 4, the inlay yarn 5 is restricted by the chain stitch yarn 6, and every portion of the chain stitch yarn 6 is restricted.

Figure 4:
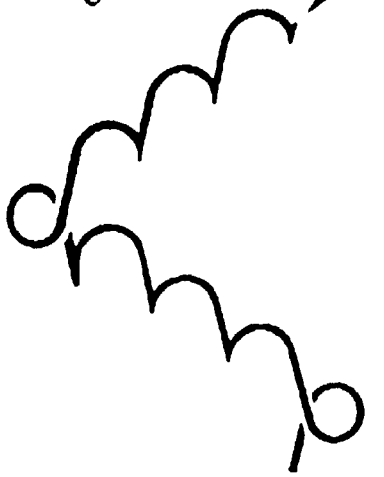
FIG. 4 is a view showing an arrangement of a chain stitch yarn used in a further example of a composite yarn in accordance with the present invention.

The chain stitch yarns of the composite yarn shown in FIGS. 1 and 3 are formed by knitting one yarn by means of one knitting needle. However, it is possible to form the chain stitch yarn by knitting the one yarn by means of several knitting needles. For example, as shown in FIG. 4, a yarn is supplied in the same direction by four courses and knitted by five knitting needles to form a chain stitch yarn 7 of an open lap, and another type of the composite yarn can be obtained by inserting an inlay yarn (not shown) into the chain stitch yarn 7. A profile of the obtained composite yarn is substantially similar to the profile of the composite yarn shown in FIG. 1, but productivity of the former composite yarn becomes remarkably inferior compared with that of the composite yarn shown in FIG. 1. Accordingly, it is practically impossible to use the former composite yarn.

A preferable manufacturing method of the composite yarn in accordance with the present invention will be described hereinafter.

Figure 5:
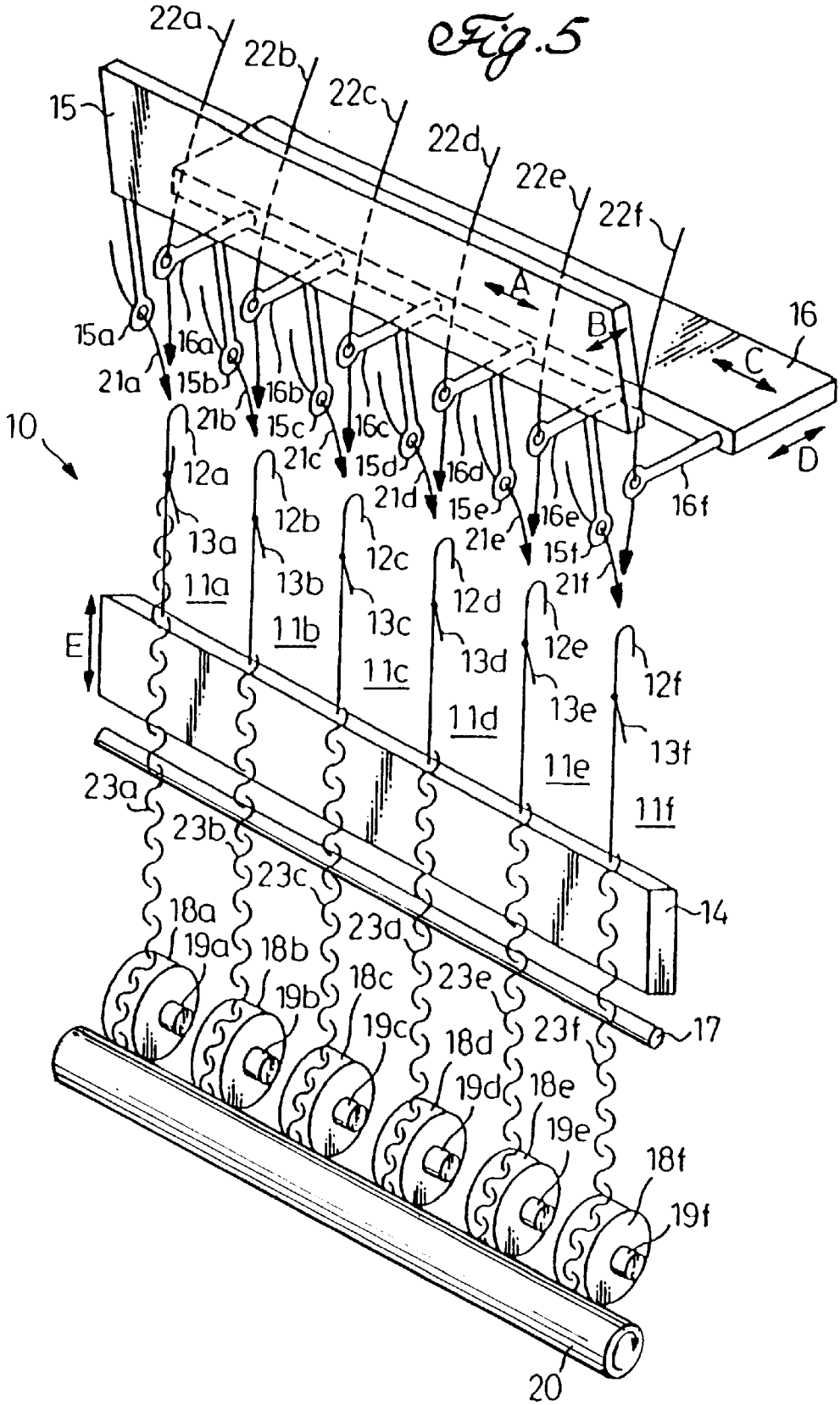
FIG. 5 is a perspective view showing an example of an apparatus implementing a manufacturing method for a composite yarn in accordance with the present invention.

FIG. 5 is a perspective view showing an example of a preferable apparatus for manufacturing the composite yarn in accordance with the present invention. As described hereinbefore, the composite yarn in accordance with the present invention is knitted on a knitting mechanism in a warp knitting machine. Accordingly only the main elements required to manufacture the composite yarn in the present invention are shown in FIG. 5, to clarify the description of the manufacturing method in accordance with the present invention, and mechanisms which are well known, by persons with ordinary skill in the art of the knitting mechanism of the warp knitting machine, are omitted from FIG. 5.

As shown in FIG. 5, a plurality of knitting stations 11*a*, 11*b*, 11*c*, 11*d*, 11*e*, and 11*f* are provided at a predetermined distance on a needle bar extending in a horizontal direction in an apparatus for manufacturing the composite yarn in accordance with the present invention. A plurality of knitting needles or latch needles 12*a*, 12*b*, 12*c*, 12*d*, 12*e*, and 12*f* are slidably provided at each knitting station 11*a* to 11*f* in the needle bar 14 and can be moved up and down as shown by an arrow E.

In the example of the manufacturing apparatus shown in FIG. 5, a front guide 15 and a back guide 16 are used. A plurality of yarn guide eye needles 15*a*, 15*b*, 12*c*, 15*d*, 15*e*, and 15*f* are arranged at the same distance as that between the knitting stations in the front guide 15, and a plurality of yarn guide eye needles 16*a*, 16*b*, 16*c*, 16*d*, 16*e*, and 16*f* are arranged at the same distance as that between the knitting stations on the back guide 16. A hole to be used as a yarn guide is provided at the top end of the each yarn guide eye needle 15*a* to 15*f* and 16*a* to 16*f*, respectively. Yarns 21*a*, 21*b*, 21*c*, 21*d*, 21*e*, and 21*f* to be used to knit chain stitch yarns are passed through the hole in the each yarn guide eye needle 15*a* to 15*f* of the front guide 15, and yarns 22*a*, 22*b*, 22*c*, 22*d*, 22*e*, and 22*f* to be used as an inlay yarn are passed through the hole in each yarn guide eye needle 16*a* to 16*f* of the back guide 16. A front guide driving device (not shown) is connected to either end of the front guide 15, and a back guide driving device (not shown) is connected to either end of the back guide 16. When driving the front guide driving device in a chain stitch yarn forming mode, and driving the back guide driving device in an inlay yarn forming mode, the yarn guide eye needles 15*a* to 15*f* and the yarn guide eye needles 16*a* to 16*f* are given a predetermined swinging motion (see arrows B and D in FIG. 5) and a predetermined shogging motion (see arrows A and C in FIG. 5), and thus each composite yarn 23*a*, 23*b*, 23*c*, 23*d*, 23*e*, and 23*f* is formed at each knitting station 11*a* to 11*f*, respectively.

In the example of the manufacturing apparatus shown in FIG. 5, the latch needles 12*a* to 12*f* have latches 13*a*, 13*b*, 13*c*, 13*d*, 13*e*, and 13*f*, respectively. However, bearded needles or compound needles may be used in place of the latch needles. Further, accessory members such as a presser, a sinker or the like are required in the knitting operation. Since a structure of the above accessory members and function thereof are well known by persons with ordinary skill in the art, the explanations for the accessory members will be omitted.

Each winding mechanism is arranged in each downstream position of each knitting station 11*a* to 11*f*. In the example shown in FIG. 5, a winding driving drum 20 is rotatably arranged below. The needle bar 14, and each yarn package 18*a*, 18*b*, 18*c*, 18*d*, 18*e*, and 18*f* is mounted on the winding driving drum 20. Each composite yarn 23*a* to 23*f* formed at each knitting station 11*a* to 11*f* is supplied via a yarn guiding bar 17 to each bobbin 19*a*, 19*b*, 19*c*, 19*d*, 19*e*, and 19*f* of the yarn packages 18*a* to 18*f*, is given to traverse motion by a traversing mechanism (not shown), and is wound on each yarn package 18*a* to 18*f* which is in contact with the winding driving drum 20.

The plurality of yarn packages 18*a* to 18*f* are arranged on a straight line in the example shown in FIG. 5. Accordingly, the height of each yarn package 18*a* to 18*f*, corresponding to a traversing length of the composite yarn during a winding operation must be smaller than the distance between the adjacent knitting stations. Weight of the yarn package having a small height is light, and thus the number of doffings of this yarn package and number of times the yarn package must be exchanged in a subsequent process increases. Accordingly, the use of the yarn package the height of which is small, causes an unpreferable increment in the manufacturing cost of the composite yarn and increment in the operation cost upon using the composite yarn in subsequent processes. It is possible to increase the height of the yarn package by increasing the distance between the adjacent knitting stations, but in this case, the production per one apparatus for manufacturing the composite yarn in accordance with the present invention decreases and causes an increase in the manufacturing cost of the composite yarn.

Figure 6:
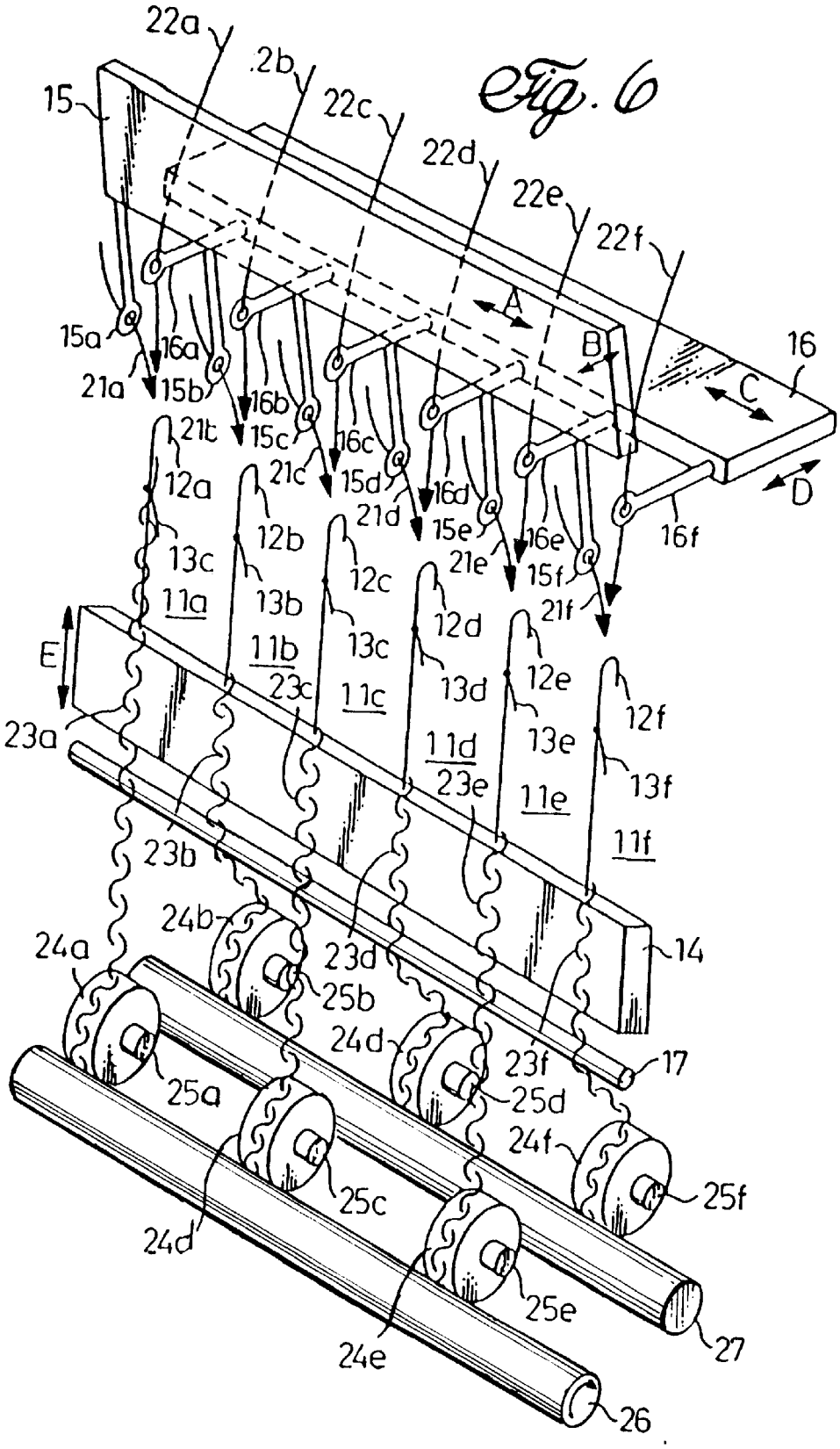
FIG. 6 is a perspective view showing another example of an apparatus implementing a manufacturing method for a composite yarn in accordance with the present invention.

To remove the above-mentioned problem, it is preferable to arrange the plurality of winding mechanisms in several rows in such a manner that all the winding mechanisms are alternately arranged. FIG. 6 shows an example in which the plurality of winding mechanisms are arranged in two rows. Two winding driving drums 26 and 27 are arranged in parallel to the needle bar 14 downstream of thy knitting stations 11*a* to 11*f*, and the yarn packages 24*a*, 24*c*, and 24*e* are in contact with the winding driving drum 26 arranged in front of the apparatus and the yarn packages 24*b*, 24*d*, and 24*f* are in contact with the winding driving drum 27 arranged at the back of the apparatus. The composite yarns 23*a*, 23*c*, and 23*e* are wound through a yarn guiding bar 17 on yarn packages 24*a*, 24*c*, and 24*e* arranged on the front side of the apparatus, and the composite yarns 23*b*, 23*d*, and 23*f* are directed by the yarn guiding bar 17 and then wound on yarn packages 24*b*, 24*d*, and 24*f*. As can be seen upon comparing FIG. 6 with FIG. 5, the size of the yarn package can be increased by about three times.

The composite yarn is wound on a parallel bobbin to make the package have a cheese-like shape in the composite yarn manufacturing apparatus shown in FIGS. 5 and 6. However, the composite yarn may be wound on a flanged bobbin. It is possible to prepare a yarn package having a short height and a large diameter by using the flanged bobbin, and as the result, it is possible to increase a number of the knitting stations to be arranged in a warp knitting machine. A winding operation of the composite yarn on the flanged bobbin can be carried out by mounting the flanged bobbin on the winding driving drum 20 shown in FIG. 5 and decreasing a rotational number of the drum 20 according to increment of a diameter of a yarn package wound on the flanged bobbin. However, the winding of the composite yarn can be also attained by mounting the flanged bobbin in an easily slipping state on the winding driving drum 20 rotated at a constant rotational speed.

Embodiments of the composite yarns in accordance with the present invention will be described hereinafter.

EXAMPLE 1

A watersoluble polyvinyl alcohol yarn 28 *d* is supplied to a front side guide of a raschel warp knitting machine having two guides to knit a chain stitch yarn, and simultaneously, a twisted yarn of nylon multifilament 70 d/2 is supplied to a back side guide as an inlay yarn to form a composite yarn. The number of course of the polyvinyl alcohol yarn in the chain stitch yarn is 50 per inch.

A power net, the unit weight per $m^2$ of which is 100 $g/m^2$, is knitted by using a nylon multifilament 30 d and a polyurethane yarn 70 d, and this power net is used as a lace ground cloth of an embroidery lace. A plurality of flower patterns are embroidered on the lace ground cloth by using the composite yarn as an embroidery yarn. There is no occurrence of yarn breakage of the embroidery yarn during the embroidery process. The thus obtained raw cloth of the embroidery lace is scoured and applied with finishing agents to make an embroidery lace. The watersoluble polyvinyl alcohol yarn of the composite yarn in the finished embroidery lace is completely dissolved. As the result, the pattern portion of the embroidery lace obtained by using the composite yarn as the embroidery yarn can be easily stretched to 2 to 2.5 times the original length of the pattern portion, and this value is substantially similar to that of the lace ground cloth having a power net structure.

COMPARATIVE EXAMPLE 1

A conventional potentially stretchable yarn to be used as embroidery yarn is manufactured by arranging a water-soluble polyvinyl alcohol yarn 28 d in parallel with a spandex yarn 70 held in a relaxed state and wrapping a nylon multifilament 30 d thereon. A raw cloth of an embroidery lace is manufactured by embroidering the potentially stretchable yarn on the same power net used in the Example 1. In this Comparative Example 1, many yarn breakages, caused by the potentially stretchable yarn clogging the eye of a shuttle, occur when the raw cloth is manufactured. Thus it is impossible to carry out mass production of the raw cloth on a large scale. The obtained raw cloth of the embroidery lace is scoured under the same conditions as in Example 1 to dissolve the watersoluble polyvinyl alcohol yarn and obtain an embroidery lace. The appearance of pattern portions of the obtained embroidery lace was inferior due to the many yarn breakages of the embroidery yarn.

EXAMPLE 2

A watersoluble polyvinyl alcohol yarn 40 d is supplied to a front side guide of a raschel warp knitting machine, having two guides, to knit a chain stitch yarn, and simultaneously, a covering yarn formed by wrapping a nylon multifilament 20 d around a spandex yarn 70 d is supplied to a back side guide as an inlay yarn to form a composite yarn.

A raw cloth of an embroidery lace is manufactured under the same conditions as in Example 1 by using the above composite yarn as an embroidery yarn, and the raw cloth is scoured and finished under the same conditions as those of Example 1 to obtain the embroidery lace. There is no occurrence of yarn breakage of the embroidery yarn during the embroidery process in this example, and an embroidery lace having a superior appearance is obtained.

EXAMPLE 3

A raschel warp knitting machine having structures shown in FIG. 5 and with the distance between adjacent knitting stations set to 20 mm is used for manufacturing a composite yarn of Example 3. In Example 3, a flanged bobbin is used in place of a parallel bobbin shown in FIG. 3.

A nylon multifilament 70 d, in which the shape of the cross-section of a single filament is irregular, is supplied to a front side guide to knit a chain stitch yarn, simultaneously, a spandex yarn 210 d is supplied to a back side guide as an inlay yarn to form a composite yarn, and the obtained composite yarn is wound onto the flanged bobbin having a winding drum of an outer diameter of 80 mm. The number of course of the nylon multifilament in the chain stitch yarn was 50 per inch. The height of the yarn package wound on the flanged bobbin was 12 mm, the diameter of the yarn package was 270 mm and the weight of the yarn package was about 310 g.

The obtained composite yarn was supplied to a front side guide and a back side guide of a conventional warp knitting machine to knit an interlock knitted fabric. The obtained knitted fabric has a superior luster and can be stretched in both a lengthwise direction and a lateral direction.

EXAMPLE 4

The same composite yarn as that in Example 3 is manufactured by using a raschel warp knitting machine having a two winding driving drums as shown in FIG. 6 and in which the distance between adjacent knitting stations was 20 mm.

The height of the yarn package wound on the flanged bobbin was 30 mm, the diameter of the yarn package was 270 mm and the weight of the yarn package was about 783 g.

This value is 2.5 times of that of the yarn package obtained in Example 3.

EXAMPLE 5

The same interlock knitted fabric as that in Example 3 is knitted by using a composite yarn manufactured under the same conditions as those used for manufacturing the composite yarn in Example 3. However, since a warp knitting machine improved to manufacturing the composite yarn in accordance with the present invention and a conventional warp knitting machine for knitting the interlock knitted fabric are arranged in the same factory in Example 5, the composite yarn obtained in the improved warp knitting machine is not individually wound to a yarn package, but 100 composite yarns manufactured in adjacent knitting stations are simultaneously wound on a sectional warping drum. The obtained sectional warping drums are mounted on a front side position and a back side position of a rack of the conventional warp knitting machine, respectively.

Accordingly, it is possible to omit a warping process used to rewind the composite yarn from the yarn package to the sectional warping drum in Example 3 and in this example, and thus cost and time for manufacturing the interlock knitted fabric can be saved compared with those in Example 3.

EXAMPLE 6

A polyester textured yarn of 75 d is supplied in a front side guide of a raschel warp knitting machine having two guides to knit a chain stitch yarn, and a watersoluble polyvinyl alcohol yarn of 56d and a spandex yarn of 70 d held in relaxed state are simultaneously supplied in a back side guide of the raschel warp knitting machine as an inlay yarn to form a composite yarn. A plain weave fabric is woven by using the composite yarn as warp yarns and a polyester multifilament of 75 d/2 as weft yarns. A warp density of the obtained woven fabric was 24 ends per cm, and a weft density of the woven fabric was 35 picks per cm. The obtained woven fabric is scoured and dyed to a dark blue colour by a high pressure dyeing machine. The watersoluble polyvinyl alcohol yarn included in the composite yarn is completely removed in the scouring and dyeing process, and the thus obtained woven fabric has stretchability in a warp direction and can be usefully used in a lady's wear.

EXAMPLE 7

A nylon textured yarn of 50 d and dyed in a red colour is supplied in a front side guide of a raschel warp knitting machine having two guides to knit a chain stitch yarn and a polyester multifilament of 75 d/2 and dyed in a dark blue colour is simultaneously supplied in a back side guide of the raschel warp knitting machine as an inlay yarn to form a composite yarn. Red portions having a stitch-like pattern can be seen in a surface of the obtained composite yarn and blue portions can be seen in inside portions of the composite yarn, and thus the composite yarn of Example 7 can be used as a novel fancy yarn having superior design effect compared with a conventional fancy yarn.

CAPABILITY OF EXPLOITATION IN INDUSTRY

Since the composite yarn in accordance with the present invention is constituted as described herein, the chain stitch yarn and the inlay yarn are surely interlaced with each other. Accordingly, there is no chance that the chain stitch yarn and the inlay yarn are separated during use of a final product of the composite yarn in accordance with the present invention. As a result, there is little occurrence of pills or snagging, even if a stretchable yarn is used as the inlay yarn, and it is possible to provide a final product having a clean appearance.

Further, since the composite yarn in accordance with the present invention has many portions which are in parallel to an axis of the composite yarn in the surface of the chain stitch yarn, the appearance of the composite yarn is relatively smooth and has superior luster. Accordingly, the composite yarn in accordance with the present invention can also be widely used for a knitting fabric or a woven fabric which cannot be manufactured using a conventional composite yarn.

I claim:

1. A composite yarn comprising:

a chain stitch yarn knitted with a non-stretchable yarn, to form a series of loops with the non-stretchable yarn along a length of the composite yarn; and at least one stretchable inlay yarn inserted into the series of loops of the chain stitch yarn, wherein the non-stretchable yarn is a soluble yarn.

2. The composite yarn according to claim 1 wherein the at least one stretchable inlay yarn is a single inlay yarn.

3. The composite yarn according to claim 1 wherein the non-stretchable yarn comprises a synthetic fiber monofilament.

4. The composite yarn according to claim 3 wherein the synthetic fiber monofilament is a soluble polyvinyl alcohol yarn.

5. The composite yarn according to claim 1 wherein the inlay yarn comprises a yarn selected from the group consisting of textured synthetic fiber yarn, spandex yarn, or natural rubber yarn.

6. A woven fabric formed by weaving a plurality of weaving yarns together, wherein at least one of the weaving yarns comprises a chain stitch yarn knitted with a non-stretchable yarn, to form a series of loops with the non-stretchable yarn along a length of the composite yarn and at least one stretchable inlay yarn inserted into the series of loops of the chain stitch yarn, wherein the non-stretchable yarn is a soluble yarn.

7. A knitted fabric formed by knitting a plurality of knitting yarns together, wherein at least one of the knitting yarns comprises a chain stitch yarn knitted with a non-stretchable yarn, to form a series of loops with the non-stretchable yarn along a length of the composite yarn and at least one stretchable inlay yarn inserted into the series of loops of the chain stitch yarn, wherein the non-stretchable yarn is a soluble yarn.

8. An embroidery lace formed by embroidering an embroidery yarn on a lace ground cloth, wherein the embroidery yarn comprises a chain stitch yarn knitted with a non-stretchable yarn, to form a series of loops with the non-stretchable yarn along a length of the composite yarn and at least one stretchable inlay yarn inserted into the series of loops of the chain stitch yarn, wherein the non-stretchable yarn is a soluble yarn.

* * * * *